US007762206B2

(12) United States Patent
Seipel et al.

(10) Patent No.: US 7,762,206 B2
(45) Date of Patent: Jul. 27, 2010

(54) UNIVERSAL WATER SPORT TOW ATTACHMENT AND SYSTEM

(76) Inventors: John Seipel, 3879 N. Richards, Milwaukee, WI (US) 53212; Mike Siepel, 3879 N. Richards, Milwaukee, WI (US) 53212

( * ) Notice: Subject to any disclaimer, the term of this patent is extended or adjusted under 35 U.S.C. 154(b) by 161 days.

(21) Appl. No.: 12/173,561

(22) Filed: Jul. 15, 2008

(65) Prior Publication Data

US 2008/0289557 A1 Nov. 27, 2008

(51) Int. Cl.

| | |
|---|---|
| ***B63B 17/00*** | (2006.01) |
| *B63B 7/00* | (2006.01) |
| *B63B 15/00* | (2006.01) |
| *B63B 21/12* | (2006.01) |
| *B63B 21/54* | (2006.01) |
| *B63B 21/56* | (2006.01) |
| *B63B 21/58* | (2006.01) |
| *B63H 9/10* | (2006.01) |
| *B25B 25/00* | (2006.01) |

(52) U.S. Cl. ..... 114/343; 114/354; 114/364; 114/89; 114/97; 114/98; 114/99; 114/221 R; 114/223; 114/242; 114/249; 114/250

(58) Field of Classification Search ..... 114/343, 114/354, 364, 89, 97–99, 221 R, 223, 242, 114/249, 250

See application file for complete search history.

(56) References Cited

U.S. PATENT DOCUMENTS

| | | | | |
|---|---|---|---|---|
| 3,303,813 A | | 2/1967 | Collins | |
| 4,384,542 A | * | 5/1983 | Wilson | 114/255 |
| 4,480,577 A | * | 11/1984 | Naypaver | 114/253 |
| 5,000,109 A | * | 3/1991 | Anderson | 114/242 |
| 5,241,921 A | | 9/1993 | Sadlak | |
| 5,730,078 A | | 3/1998 | Rummell | |
| 5,934,217 A | | 8/1999 | Allsop | |
| 5,943,977 A | | 8/1999 | Womack | |
| 6,192,819 B1 | * | 2/2001 | Larson et al. | 114/253 |
| D465,194 S | | 11/2002 | Eck | |
| 6,543,296 B1 | * | 4/2003 | Bermudez | 73/828 |
| 6,575,112 B2 | * | 6/2003 | Roeseler et al. | 114/253 |
| D480,349 S | | 10/2003 | Carlton | |
| 6,666,159 B2 | * | 12/2003 | Larson et al. | 114/253 |
| 7,216,604 B2 | * | 5/2007 | Finney et al. | 114/361 |
| 7,299,761 B2 | | 11/2007 | Larson | |
| 7,520,236 B2 | * | 4/2009 | Seipel et al. | 114/253 |

OTHER PUBLICATIONS

U.S. Appl. No. 11/753,997, filed Nov. 27, 2008, Selpel, Michael.
Barefoot Advertisment www.waterskis.com, published May 2008.
Barefoot Boom Industry Secrets Revealed Dec. 12, 2007.

* cited by examiner

*Primary Examiner*—Daniel V Venne
(74) *Attorney, Agent, or Firm*—Absolute Technology Law Group, LLC

(57) ABSTRACT

The invention disclosed herein is a universally adaptable, collapsible, adjustable boom designed for selective attachment and detachment to any configuration of a boat tower, and which provides multiple support points to counteract the downward force exerted by a water sport participant. Attachment and detachment of the boom is efficiently accomplished with the use of adjustable clamps and lynch pins, and the boom further secured by a cabling system.

16 Claims, 9 Drawing Sheets

UNIVERSAL WATER SPORT TOW ATTACHMENT AND SYSTEM

CROSS-REFERENCE TO RELATED APPLICATIONS

This application claims priority to U.S. application Ser. No. 11/753,997 filed May 30, 2007 ("Elevated Water Sport Tow Extension Apparatus").

FIELD OF INVENTION

This invention relates generally to the field of towing and support units for use in water sports, and in particular, to an adjustable and collapsible device that can be attached directly to any boat tower support structure.

BACKGROUND

Water sports such as water skiing, wake boarding, and barefoot skiing require the participant to learn to maintain his or her balance on the surface plane of water while being pulled by a boat. Various devices known in the art, such as booms and boat towers, are used by water sport participants during training and when performing stunts and physical maneuvers.

Booms are attachments which, in the prior art, are attached to the pylon of a boat and/or gunwale (side) of a boat. (A pylon is a pole that extends up from the center of the boat on which a tow rope is attached.)

A boom provides support to a water sport participant, generally during training, allowing the water sport participant to achieve equilibrium and maintain his or her balance on the surface plane of water while the boat is moving. Additionally, the use of a boom alongside the boat, rather than a tow rope attached to the pylon of the boat, allows a water sport participant who is training to position themselves along the side of the boat in order to more easily receive instruction.

A water sport boom is attached to the pylon and/or gunwale of the boat. The boom is positioned across the side, or gunnel, of the boat and extends laterally over the water so that the barefoot skier can grasp the boom and be pulled through the water along the side of the boat. A boom for water skiing is shown in U.S. Pat. No. 5,241,921; A further refinement of a traditional, water sport; boom, a powered boom assembly that allows boat personnel to activate a switch to automatically change the position of the boom while the boat is operating and while the skier is using the boom, is taught by U.S. Pat. No. 5,730,078.

Attaching a boom to a pylon and/or extending the boom over the gunwale has several limitations. The boom has a single attachment point, and all downward pressure exerted by the skier must be supported at this single point. Moreover, there is no utilization of diagonal or angle forces.

Additionally, this design obstructs passengers in the passenger area of the boat, and causes stress on the gunwale of the boat. Moreover, due to wide variations in pylon and boat designs, it cannot be used on all boats. For example, the V-Drive boom offered by Barefoot International, Inc., according to the manufacturer, can be used only on "V-Drive boats with pylons in the rear that stick up past [the] sundeck at least three inches." Examples include the New MasterCraft Maristar boats. "Malibu V-Drives prior to 2000 need a pylon extension replacement."

The widespread use of boat tower attachments since the late 1990s has led to the development of water sport accessories which attach to boat towers.

A tower attachment, as illustrated in U.S. application Ser. No. 11/753,997 (the '997 application), is a vertical structure which extends upward from the rear of the boat and may be used for attaching tow ropes to assist a water sport participant or for mounting accessories such as equipment racks, lighting or speakers.

Virtually every water sport boat manufacturer offers a boat tower as either standard or optional equipment. Boat towers are of varying dimensions and specifications. Original Equipment Manufacturers (OEMs) offer numerous customized towers which correspond to the dimensions of various boat types and models. OEMs also make numerous types of boat towers which they sell directly to boat owners who later want to add a tower to a boat that originally was ordered or manufactured without one. Additionally, many custom towers may have additional, specially positioned support members to increase their stiffness.

Moreover, towers may be constructed from various sizes of tubing, or may be conceivably designed or constructed from non-tubular components. For example, larger diameter tubing may be used by manufactures of both custom and universal adjustable towers to compensate for design limitations and to increase rigidity.

It is desirable to attach structural components, such as horizontal and water sport booms; to boat towers.

It is further desirable to have an adjustable tower extension that can be used with all makes and models of boat towers, and which safely accommodates a wide range of structural variations in custom and universal boat towers, as well as anticipates future design modifications in boat towers.

It is further desirable to reduce manufacturing costs associated with boat tower booms through use of a system that makes mass production practical, making it easier for local dealers to keep boat towers booms in inventory for immediate delivery or installation.

It is further desirable to create a selectively attachable boat tower boom structure that can be easily removed and stored.

GLOSSARY

As used herein, the term "arm brace" or "brace" means a component of a universal tower boom that is used in a configuration to support or brace a boom. A brace may be constructed of aluminum, steel, other metal alloys, fiberglass, plastic, resin or any other material known in the art. An arm brace may be hollow, solid, tubular, non-tubular, flattened strips, rods or cables. An arm brace may be constructed from any number of parts, and may include turnbuckles, joints, hinges, telescoping components, welded components, and optional components to adjust the size or length. A brace, as used herein, may include apertures and other structural adaptations for attachment. For example, threaded or non-threaded apertures may be included in the arm brace to support clamps, cables, screws, bolts, or other structures. Clamps or other components may be integrally molded or attached as a component of the arm brace, or may be separate components.

As used herein, the term "arm brace clamp" means a structure which encloses a tubular or non-tubular support component of a tower extension and securely attaches the arm brace to the tubular or non-tubular component of the tower extension while the tower boom is attached or affixed to a tower extension.

As used herein, the term "boom" or "boom attachment" means a structure or attachment that extends from a boat substantially parallel to the water, or at an angle appropriate to accommodate a particular water sport maneuver. A boom attachment may be designed to be grasped or held by a water sport participant, or may be adapted to support a tow rope, harness or any other water sport accessory or functional equivalent for non-water sport activities known in the art.

As used herein, the term "bow" means the front of a boat.

As used herein, the term "cable" or "cable system" means one or more cables made of stainless steel or other material, or a plurality of cables enclosed % within a casing such as plastic or padded material. The terms cable and cable system are used inter-changeably herein. An example of a cable system is a proprietary cabling system manufactured by Barefoot International, Inc. which includes two stainless steel cables covered by a plastic outer coating and a four foot padded casing which will not damage the surface of a boat, and which provides redundant support in the event of a cable failure. A cable, as used herein, may serve the function of a forestay. Additionally, a cable or cable system may include a component for adjusting the length of cables, through which the cable or cables are threaded.

As used herein, the term "detent" means any locking device known in the art that permits movement of a machine part in one direction without the direct application of force needed to release the part. For example, a detent may include a lever or spring-loaded catch, or ball and pin components. In one embodiment, a detent may include a pin that releases two components attached or secured by the detent when pressure is applied.

As used herein, the term "end cap" means a spool-shaped or flattened piece that fits on the end of a tubular or other structure.

As used herein, the term "eyelet" means a component on the back of a boat to which a rope can be fastened, and which may include a metal loop or t-shaped protrusion.

As used herein, the term "gunwale" means the upper edge of the side of a boat.

As used herein, the term "quick release pin" means a component such as a pin or lever designed to provide repetitive and secure attachment of a component. For example, a quick release pin may include detent balls at the end of a pin that fit snugly against the mating surface. A quick release pin releases an attached or engaged component when pressure is applied. For example, pushbutton actuation may permit the balls to retract into the pin, allowing for easy insertion or removal.

As used herein, the term "rear" means the back of a boat.

As used herein, the term "spool" means a pin, bolt or hook on which another part pivots; or a hook, bolt, pin or indentation for attaching a rope.

As used herein, the term "tapered" means any structure that is non-uniform in dimension. For example, a tapered arm brace may include tapered ends that are narrower in diameter to allow attachment to a clamp or other device.

As used herein, the term "towing accessory" means a rope, harness or any other accessory which may be grasped by or connected to a water sport participant to provide support to the water sport participant.

As used herein, the term "tow," "towing" or "towed" means the act or function of pulling, supporting or moving a water sport participant. For example, a water participant in training may be towed by directly grasping a boom without the use of an intervening accessory. Towing may incorporate the use of accessories such as ropes and harnesses, or any other device known in the art for use by water sport participants. The term tow may used interchangeably with the word support.

As used herein, the term "tower" or "boat tower attachment" means a device attached to the rear of a boat to which a tow rope or other water sport accessory or accessories may be attached. One purpose of a tower may be to give water sport participants height and leverage when performing jumps and other maneuvers. A tower may be manufactured for attachment to any boat (universal), made for a specific boat or boat model (custom), factory-installed, after-market, selectively removable or collapsible. A tower may be constructed from any variation of tubular or non-tubular structural components, having uniform or varying thicknesses, strengths and dimensions.

As used herein, the term "turnbuckle" means any structural feature that provides connectivity and adjustability for tubular structures, connecting components and/or rods, and which is used to connect, tighten or adjust the length of one or more components. A turnbuckle may or may not be threaded.

As used herein, the term "water sport" means any game, sport or recreational activity which utilizes the motion of a water vehicle, including, but not limited to, water skiing with one or multiple skis, barefoot "skiing," wake boarding, wake skating, and wake surfing. A water sport may utilize any accessory known or designed for sport or recreation, including planing devices, balancing devices, and foam, fiberglass, wood, metal or inflatable devices.

SUMMARY OF INVENTION

The present invention is a secure, universal boom by which components are pivotally engaged or attached to a boat tower (support structure). The invention utilizes a unique clamping system for pivotally attaching a water sport towing apparatus (boom) to a boat tower. The universal boom described herein includes multiple attachment points and structural support components, which support a boom attachment or any type of towing apparatus on both custom and universal boat tower structures. The universal boom disclosed herein is selectively removable and adjustable without the use of levers or moving parts. The unique clamping system for attaching a device to a boat tower permits secure attachment of a boom to a boat tower which is sufficient to counteract the downward force exerted when a water sport participant grasps the boom or other towing device while the boat is in motion, and which utilizes diagonal forces. In addition, various embodiments of the invention disclosed herein may further include one or more cables or forestays, including but not limited to a dual padded stainless steel cable system attaching the boom the bow. The universal boom or other towing apparatus may further incorporate the use of one or more quick release pins for ease of assembly and selective attachment and detachment.

DETAILED DESCRIPTION OF EMBODIMENTS OF THE INVENTION

Figure 1B:
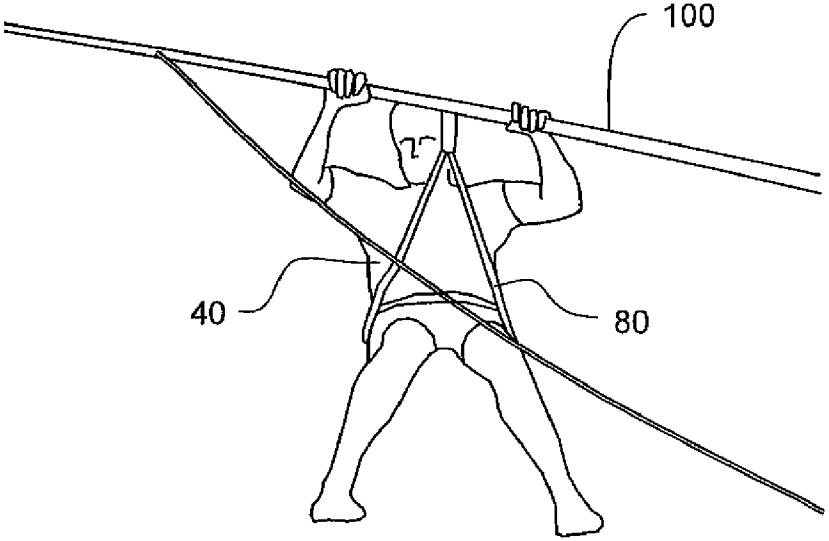
FIG. 1*b* illustrates an exemplary embodiment of a universal boom attachment in use by a water sport participant with a water sport towing accessory (harness).

For the purpose of promoting an understanding of the present invention, references are made in the text hereof to embodiments of a universal boom attachment, only some of which are described herein. It should nevertheless be understood that no limitations on the scope of the invention are thereby intended. One of ordinary skill in the art will readily appreciate that modifications such as the dimensions of the universal boom attachment, the use of alternate but functionally similar material(s), and the inclusion of additional elements are deemed readily apparent and obvious to one of ordinary skill in the art. Equivalent relationships to those described in the written description do not depart from the spirit and scope of the present: invention. Some of these possible modifications are mentioned in the following descriptions of exemplary embodiments. Therefore, specific details disclosed herein are not to be interpreted as limiting, but rather as a basis for the claims and as a representative basis for teaching one of ordinary skill in the art to employ the present invention in virtually any appropriately detailed apparatus or manner.

It should be understood that the drawings are not necessarily to scale, with emphasis instead being placed upon illustrating the principles of the invention. In addition, in the embodiments depicted herein, like reference numerals in the various drawings refer to identical or near identical structural elements.

Moreover, the term "substantially" or "approximately" as used herein may be applied to modify any quantitative representation that could permissibly vary without resulting in a change in the basic function to which it is related. For example, one embodiment of the universal boom attachment as disclosed herein includes a cabling system marketed by Barefoot International, Inc. which a includes cable adjusting component manufactured and sold by Barefoot international, Inc. through which cables are threaded and made adjustable. Other embodiments may omit the cable or cable system or use an alternate adjustable or non-adjustable cable system. Alternate clamps or devices functioning as clamps may be substituted while having the same function as features of the invention described herein.

Figure 1A:
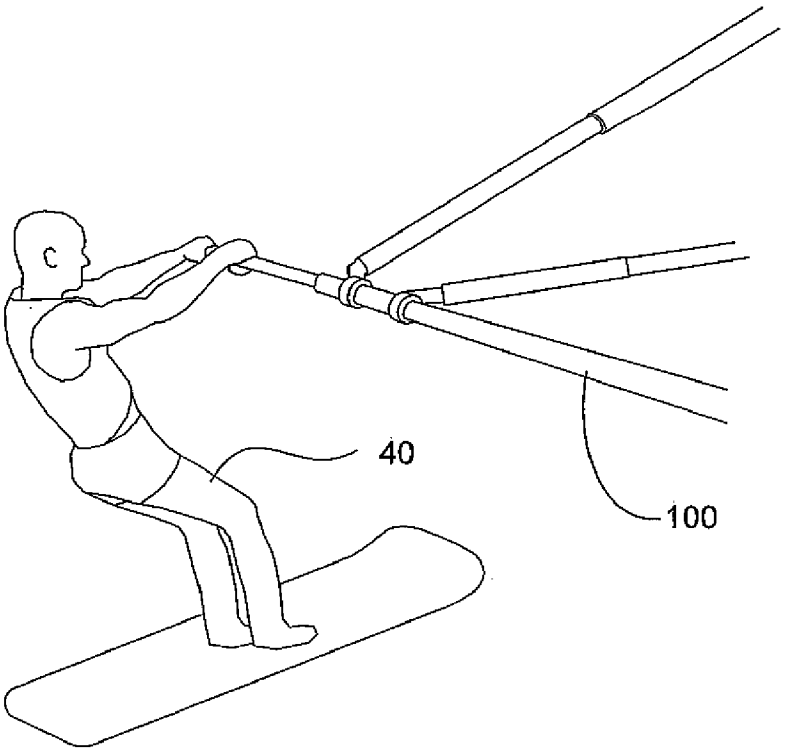
FIG. 1*a* illustrates an exemplary embodiment of a universal boom attachment in use by a water sport participant grasping the device for support.

FIG. 1*a* illustrates one exemplary embodiment of a universal boom attachment 100 in use. A water sport participant 40 grasps or is supported by the universal boom attachment 100.

FIG. 1*b* illustrates a further exemplary embodiment of a universal boom attachment 100 in use by a water sport participant 40 in conjunction with a water sport towing accessory. In the embodiment shown, the water sport participant 40 is seated in an optional harness 80 suspended from a universal boom attachment 100. In the embodiment shown, optional harness 80 is a commercially available water sport harness known in the art such as that manufactured by Barefoot International, Inc.

Figure 2A:
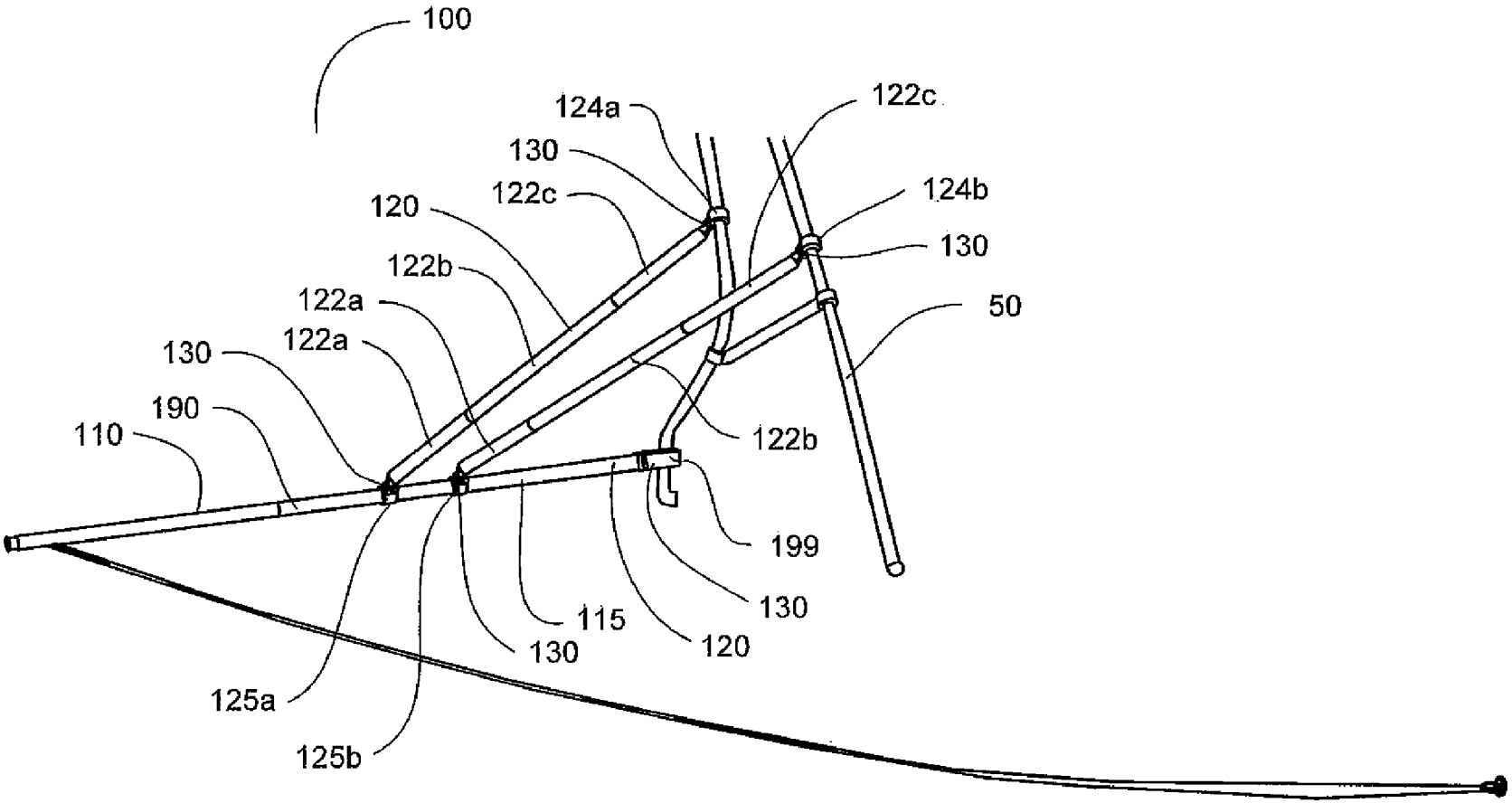
FIG. 2*a* illustrates a side perspective view of one exemplary embodiment of a universal boom attachment attached to a boat tower.

FIG. 2*a* illustrates a side perspective view of one exemplary embodiment of a universal boom attachment 100 attached to a boat tower 50. Universal boom attachment 100 includes hollow boom component 115 nearest to the body of the boat and solid boom component 110 slidably attached to hollow boom component 115. In the embodiment shown, solid boom component 110 is solid and hollow boom component 115 is at least partially hollow, to allow solid boom component 110 to slide within hollow boom component 115. Both hollow boom component 115 and solid boom component 110 are constructed of moderate to high quality aircraft aluminum that has strong tensile strength but sufficient flexibility to avoid breakage when used for support by a water sport participant 40. In other embodiments, the hollow boom component 115 and solid boom component 110 may be constructed of other types of aluminum, stainless steel, plastic or metal alloys.

In the embodiment shown, the solid boom component 110 and hollow boom component 115 are approximately 26 to 60 inches in length, but in other embodiments, they may be of varying lengths to accommodate structural variations in components of tower boom structures used for various boat makes and models. These may include both customized tower structures for specific boat types and universal tower structures which may be sold as optional or after-market components. Tower boom structural variations for which this invention is contemplated may include the use of varying widths of tubular structures and the use of non-tubular structures or structural components having apertures or special configurations adapted to engage a tower boom structure.

Although the embodiment shown depicts a hollow boom component 115 and a solid boom component 110, in various embodiments the boom components 110 and 115 may both be hollow, both be solid, or may include any configuration of inner channels and recesses.

In the embodiment shown, the solid boom component 110 slides within the hollow boom component 115, and both boom components have an aperture 188 (not visible) through which detent pin 190 is inserted to further secure their placement. Furthermore, although the solid boom component 110 slides within hollow boom component 115, in various embodiments boom components 110 and 115 may be detachable, a singly constructed unit, hinged, interlocking or fixedly attached. Additionally, in other embodiments, the solid boom component 110 and hollow boom component 115 may themselves be constructed of multiple detachable or permanently attached components. In still other embodiments, the solid boom component 110 may fully slide within hollow boom component 115, or may be engaged by a mechanism that allows only a portion of the solid boom component 110 to slide within the hollow inner main boom component 115.

FIG. 2*a* further illustrates two braces 120 constructed of three detachable pieces: bow brace end components 122*a* and 122*c* and bow brace center component 122*b*.

In the embodiment shown, bow brace components 122*a*, 122*b* and 122*c* are adjustable. In the embodiment shown, they are made adjustable and connected by turnbuckles.

In the embodiment shown, bow brace end components 122*a* and 122*c* and bow brace center component 122*b* are hollow and tubular, but in other embodiments may be solid and non-tubular or singularly constructed. Additionally, in other embodiments, braces 120 may be constructed of telescoping or hinged components, rather than turnbuckles, to permit greater portability and ease of storage. In the embodiment shown, braces 120 are approximately 48 to 50 inches long, but may be of varying lengths to be proportionate to differing custom and/or universal tower boom structures. In the embodiment shown, brace end components 122*a* and 122*c* are tapered at both ends and have apertures in each end to receive lynch pins 130 which are used to engage upper brace/boom clamps 124*a* and 124*b* and lower brace/boom clamps 125*a* and 125*b*. Lynch pins 130 may be of varying lengths and styles to accommodate various structure dimensions of upper brace/boom clamps 124*a* and 124*b* and lower brace/boom clamps 125*a* and 125*b*.

In the embodiment shown, upper brace/boom clamps 124*a* and 124*b* encircle one or more vertical structures of the boat tower 50. Lower brace/boom clamps 125*a* and 125*b* engage the hollow boom component 115 at two attachment points. The attachment points for upper brace/boom clamps 124*a* and 124*b* and lower brace/boom clamps 125*a* and 125*b* may vary depending on the size and configuration of the tower boom structure.

In the embodiment shown, upper brace/boom clamps 124*a* and 124*b* are attached to a single vertical structure of boat tower 50, but in various other embodiments may engage more than one structural component of boat tower 50 or may have multiple attachment points.

In the embodiment shown, upper brace/boom clamps 124*a* and 124*b* and lower brace/boom clamps 125*a* and 125*b* are adapted to accommodate round tubular tower boom structures, but may be alternately configured to accommodate square or rectangular tubular structures, or may accommodate flattened or solid tower boom support structures.

The embodiment shown also includes main boom lynch pin 199 which is used to secure one end of the hollow boom component 115 to a tower boom structure. In the embodiment shown, the hollow boom component 115 is attached to the tower boom structure through an aperture in the hollow boom component 115 with main boom lynch pin 199.

Figure 2B:
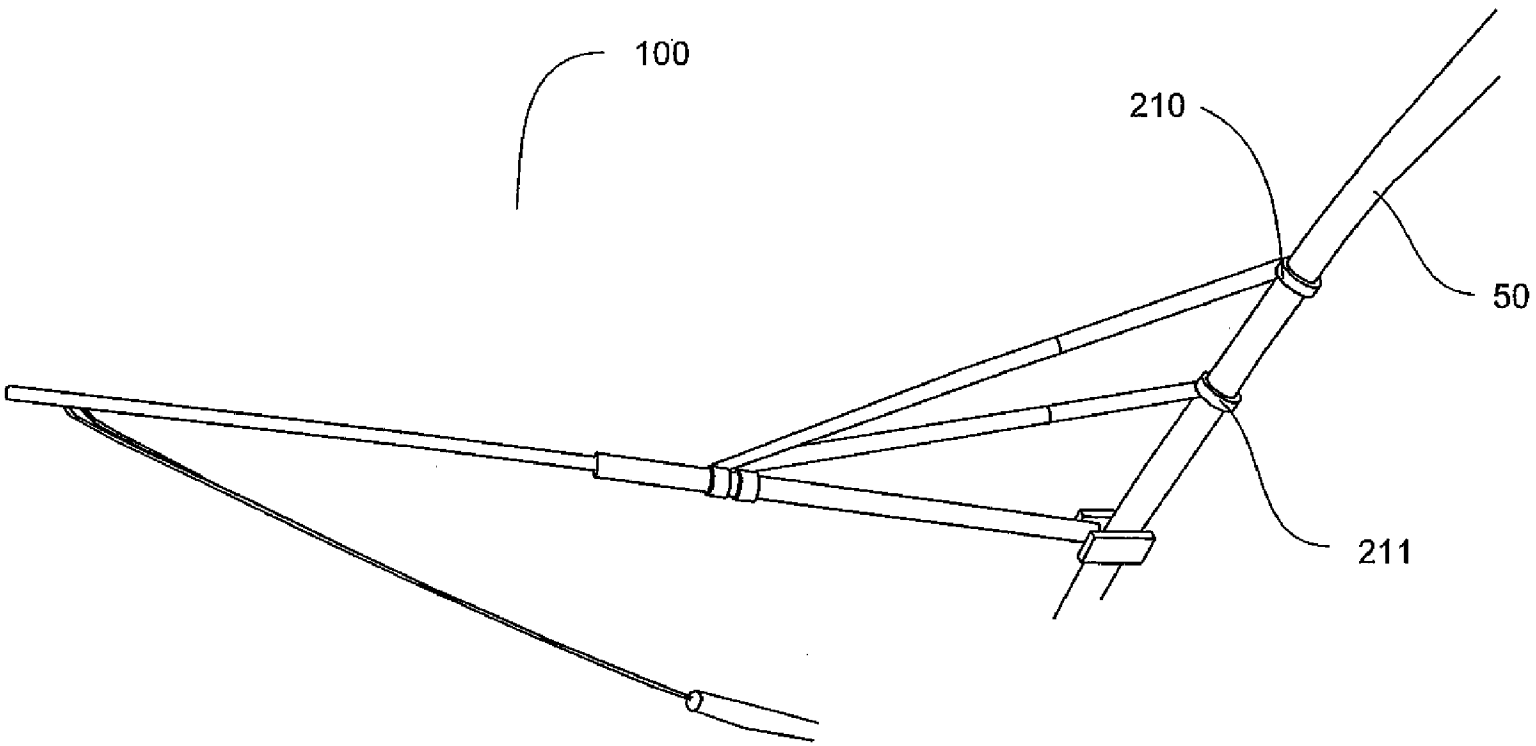
FIG. 2*b* illustrates a side perspective view of a further exemplary embodiment of a universal-boom attachment attached to a boat tower.

FIG. 2*b* illustrates a side perspective view of a further exemplary embodiment of a universal boom attachment 100 attached to a boat tower 50 at alternate attachment points 210 and 211.

Figure 3:
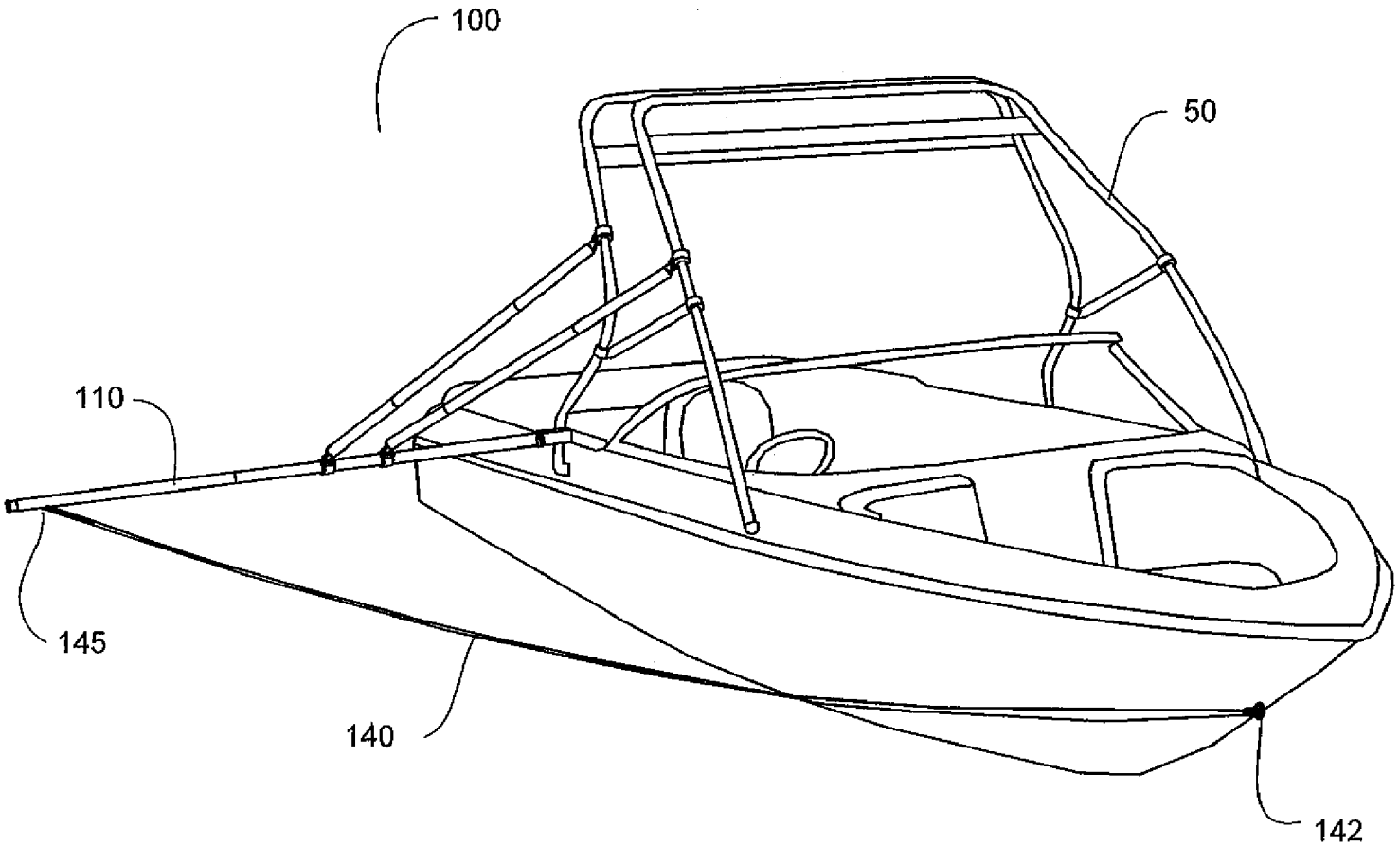
FIG. 3 illustrates a front view of a universal boom attached to a tower, and which shows the boom cable attached to an eyelet at the stern of a boat.

FIG. 3 depicts universal boom attachment 100 in use on a boat, in which cable 140 is visible. In the embodiment shown, cable 140 is attached to solid boom component 110 through boom aperture 145 at one end of cable 140. The opposite of end of cable 140 is attached to the boat tower 50 at an eyelet 142. In an alternative embodiment, universal boom attachment 100 may omit cable 140. In the embodiment shown, cable 140 is a cable system manufactured by Barefoot International Inc., which includes two stainless steel cables encased within a plastic and/or padded sleeve to prevent damage and contact of the steel cable against the surface of the boat body, but in other embodiments may be any cable configuration known in the art.

Figure 4:
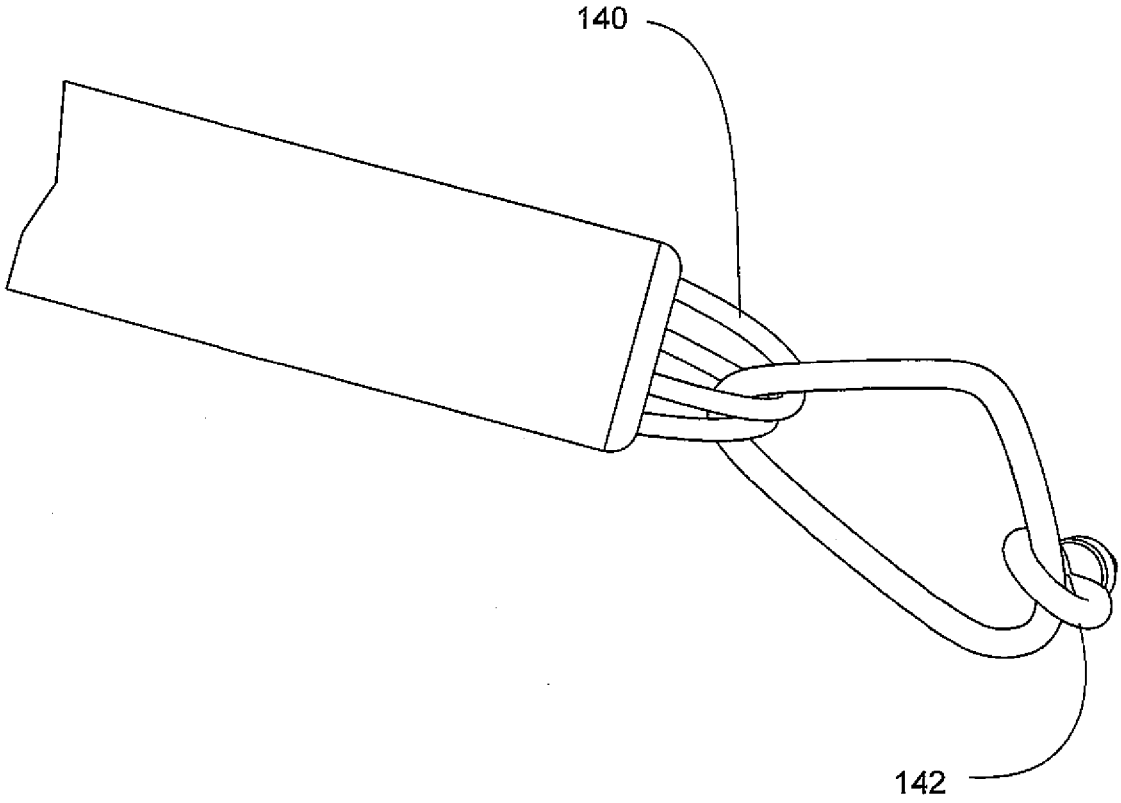
FIG. 4 illustrates a front view of a portion of a boom cable.

FIG. 4 illustrates a front view of a portion of a cable 140 attached to an eyelet 142 at the stern of a boat. As illustrated by FIG. 4, in the embodiment shown, cable 140 is a cable system manufactured by Barefoot International Inc., which includes two stainless steel cables encased within a plastic and/or padded sleeve to prevent damage and contact of the steel cable against the surface of the boat body.

Figure 5:
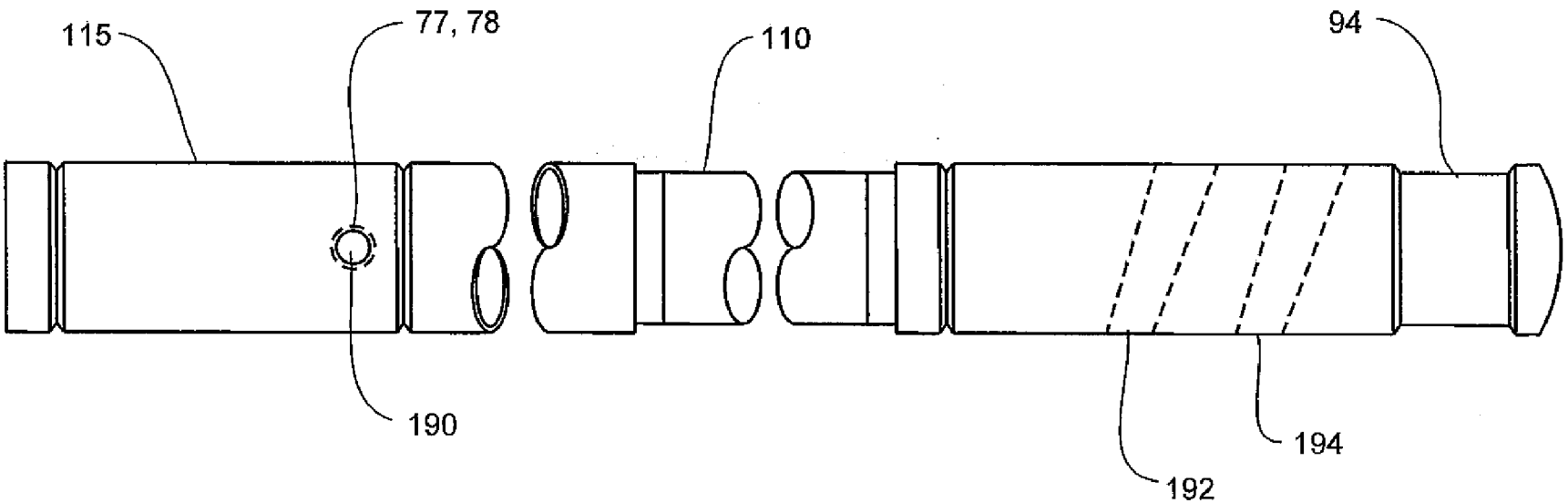
FIG. 5 illustrates a hollow and solid boom component in the detached position.

FIG. 5 illustrates an a hollow boom component 115 and a solid boom component 110 in the detached position, including detent pin apertures 77 and 78 through which detent pin 190 is inserted. The embodiment shown includes a spool 94 at the end of the solid boom component 110, to which a tow rope may be attached. In the embodiment shown, spool 94 is a Delron plastic spool known in the art, or equivalent structure. The embodiment shown also includes cable apertures 192 and 194 that are narrow at one end to receive a solid object attached to cable 140 (not shown) at one end, which acts as a stop to secure cable 140 (not shown) to the solid boom component 110. Other embodiments may have fewer or more cable apertures 192 and 194, and apertures may be of varying circumferences and configurations or may be placed on the hollow boom component 115.

Figure 6:
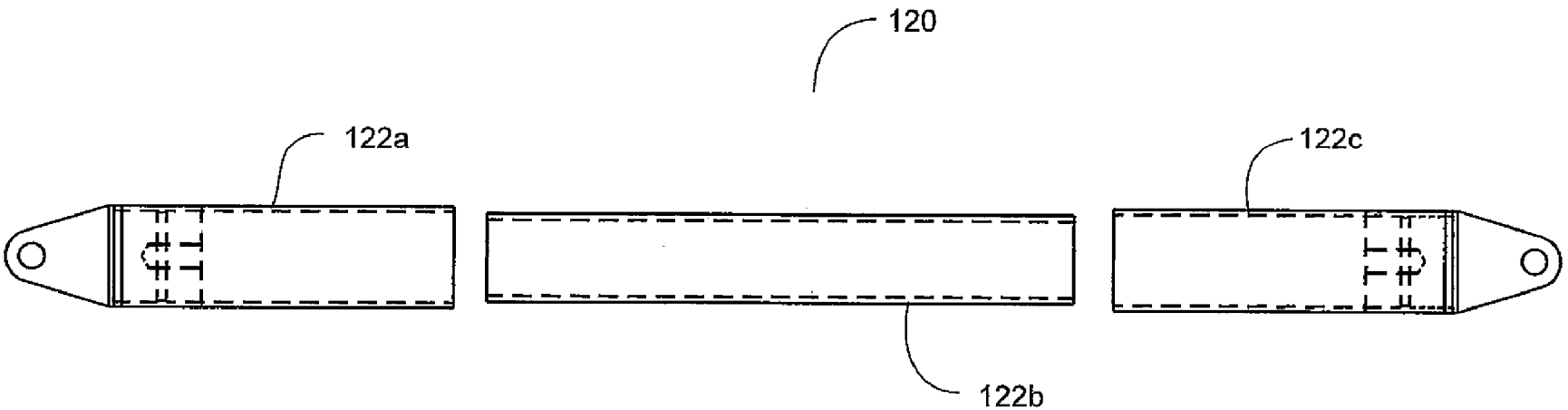
FIG. 6 illustrates an exploded view of an exemplary embodiment of a brace constructed from a turnbuckle component and two tapered end components.

FIG. 6 illustrates an exploded view of an exemplary embodiment of a brace 120 constructed from a turnbuckle component and two tapered end components. In the embodiment shown, brace 120 is constructed of three detachable pieces: bow brace end components 122*a* and 122*c* and bow brace center component 122*b*. Bow brace end components 122*a* and 122*c* have tapered ends with apertures adapted to receive lynch pins that secure them to clamps attached to tower boom structures. In the embodiment shown, braces 120 are turnbuckles.

Figure 7B:
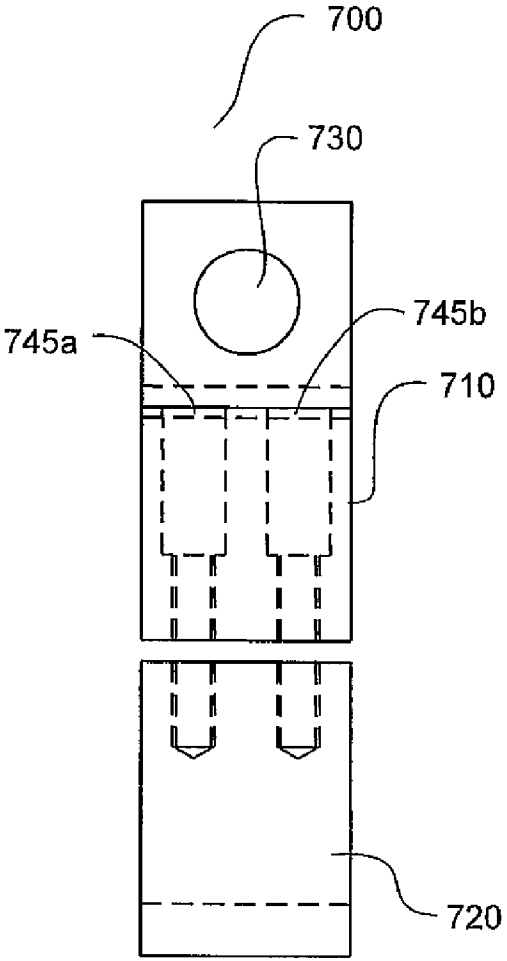
FIG. 7*b* illustrates a side view of a tower clamp.
Figure 7A:
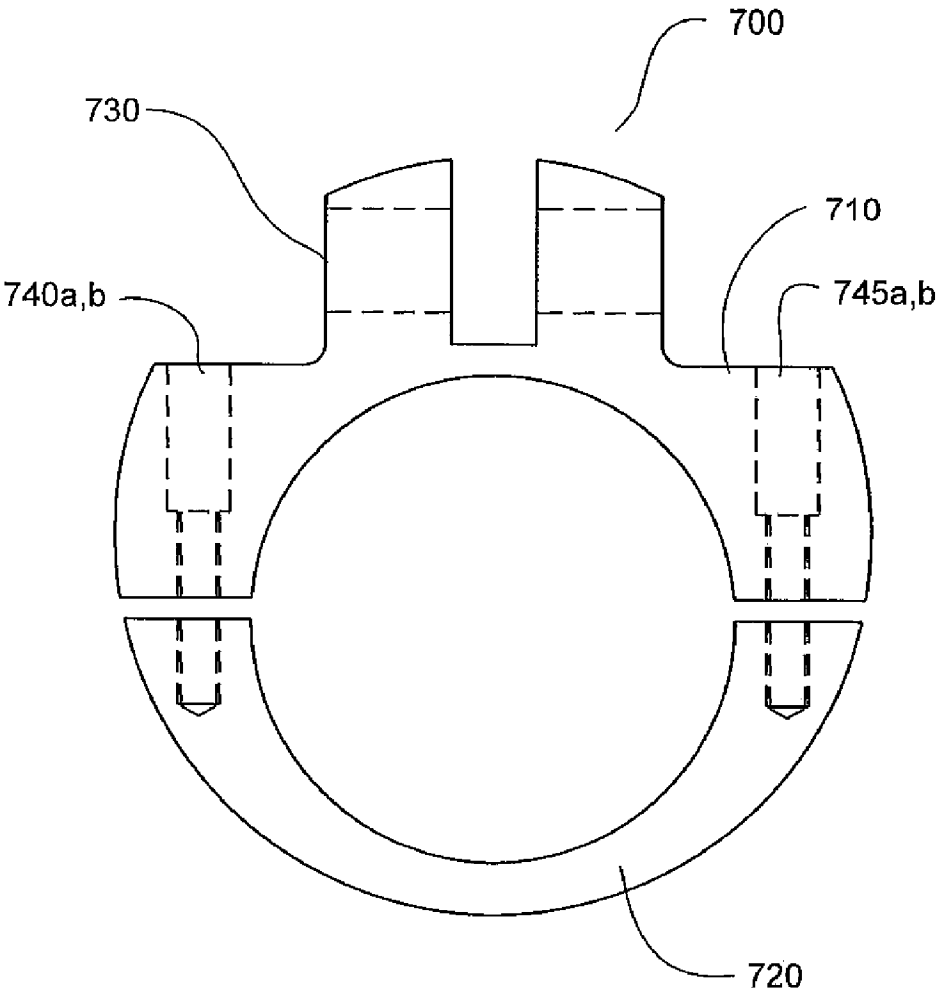
FIG. 7*a* illustrates a front top view of a tower clamp.

FIG. 7*a* illustrates a front top view of tower clamp 700, including connecting halves 710 and 720, lynch pin aperture 730, and threaded screw apertures 740 and 745 that secure connecting halves 710 and 720. In other embodiments, connecting halves 710 and 720 may be a single structure that is temporarily or permanently affixed to a boat tower 50. Connecting halves 710 and 720 may, accordingly, omit or include threaded screw apertures 740 and 745. In the embodiment shown, tower clamp 700 is adjustable through the use of screws inserted into threaded screw apertures 740 and 745, and may include optional lengthening screws or other functionally similar components.

FIG. 7*b* illustrates a side view of a tower clamp 700 showing pin aperture 730, and threaded screw apertures 740 and 745 that secure connecting halves 710 and 720.

Figure 8A:
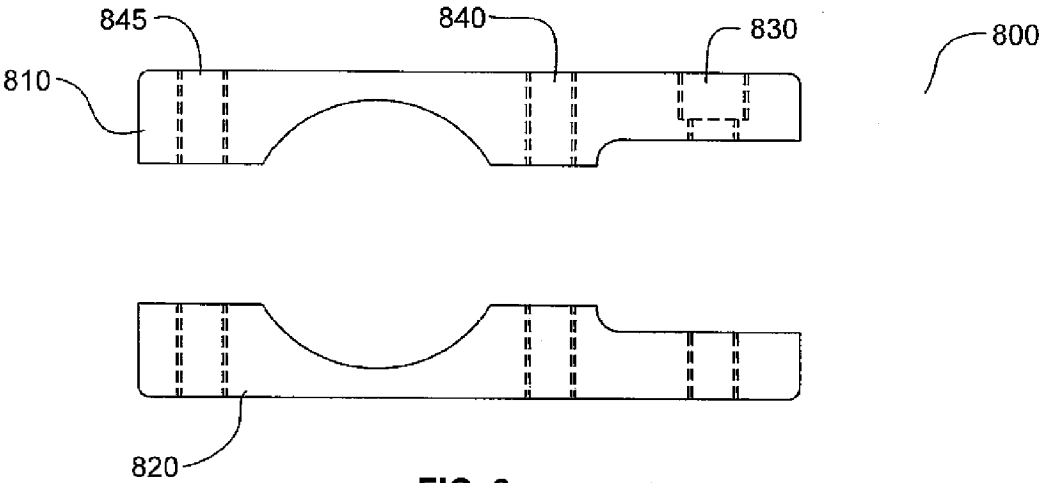
FIG. 8*a* illustrates a front top view of a tower boom clamp.

FIG. 8*a* illustrates a front top view of main tower boom clamp 800 including connecting components 810 and 820, lynch pin aperture 830, and threaded screw apertures 840 and 845 that secure connecting components 810 and 820.

Figure 8B:
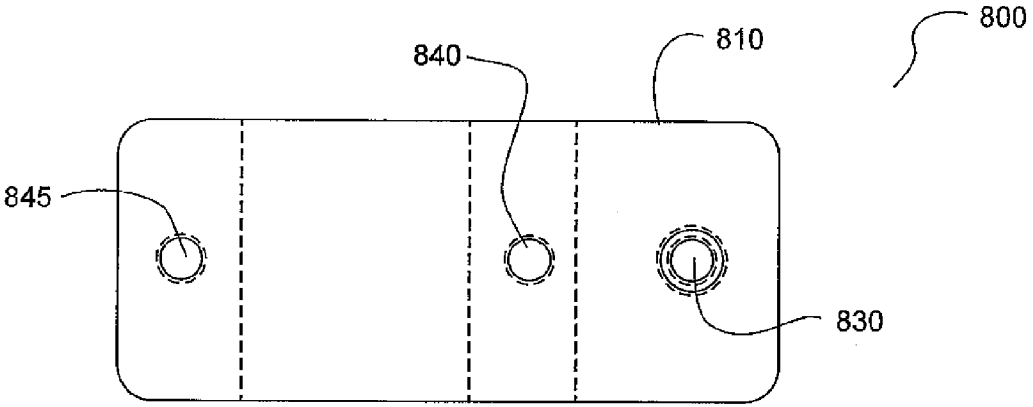
FIG. 8*b* illustrates an exploded side-view of a tower boom clamp.

FIG. 8*b* illustrates a side view of main tower boom clamp 800 showing lynch pin aperture 830 and threaded screw apertures 840 and 845 that secure connecting components 810 and 820.

What is claimed is:

1. An apparatus secured to a boat tower comprising:

a hollow boom component having a first end and a second end, said first end and said second end having an aperture to receive a detent pin;

a solid boom component having a first end and a second end, said first end having an aperture to receive a detent pin, said solid boom component slidably attached to said hollow boom component so that said solid boom component is capable of sliding within said hollow boom component, said hollow boom component and said solid boom component constructed of aircraft aluminum;

a detent pin which is inserted through said aperture in said first end of said hollow boom component and said aperture in said second end of solid boom component securing placement of said solid boom component and said hollow boom component;

at least one brace constructed of a first bow brace end component, a bow brace center component, and a second bow brace end component, wherein one end of said first and second bow brace end components is tapered having an aperture;

at least one brace clamp for securing sad at least one brace to said hollow boom component, said at least one brace clamp having an aperture adapted to receive a pivotal attachment member;

at least one tower clamp for securing said at least one brace to said boat tower, said at least one tower clamp having an aperture to receive a quick release pin:

at least one main boom clamp which secures said hollow boom component to said boat tower, said at least one main boom clamp having an aperture to receive a quick release pin;

at least one quick release pin which is inserted through said aperture in said at least one tower clamp and said aperture in said second bow brace end component;

at least one quick release pin which is inserted through said aperture in said at least one main boom clamp and said aperture in said second end of said hollow boom component; and at least one pivotal attachment member which is inserted through said aperture in said at least one brace clamp and said aperture in said first bow brace end component.

2. The apparatus of claim 1, wherein said at least one brace clamp and said at least one main boom clamp are pivotal attachment members which may be adjusted to accommodate any boat tower structure.

3. The apparatus of claim 2, wherein said at least one brace clamp has at least one clamp aperture adapted to engage said at least one brace with a corresponding brace aperture using a lynch pin.

4. The apparatus of claim 1, wherein said at least one brace has at least one tapered end adapted to be engaged by said at least one brace clamp having a lynch pin.

5. The apparatus of claim 1, which includes at least one cable securing said boom to a boat.

6. The apparatus of claim 5, wherein said cable is adjustable.

7. The apparatus of claim 5, wherein said boom contains at least one cable aperture to receive one end of said cable.

8. The apparatus of claim 1, wherein said at least one brace includes at least one turnbuckle.

9. The apparatus of claim 1, wherein said tower clamp is adjustable to conform to the structure of any boat tower.

10. The apparatus of claim 1, wherein said main boom clamp is adjustable to conform to the structure of any boat tower.

11. A method of securing an apparatus to a boat tower comprising:

attaching a boom to said boat tower structure using an adjustable main boom clamp secured with a quick release pin;

attaching at least one brace to said at least one boom using an adjustable brace clamp with a pivotal attachment member; and securing said at least one brace to said boat tower structure using an adjustable tower clamp secured with a quick release pin to provide a force, which counteracts the downward force exerted by a water sport participant supported by said boom.

12. The method of claim 11 which further includes the step of adjusting said main boom clamp to conform to the structure of any boat tower.

13. The method of claim 11 which further includes the step of adjusting said adjustable tower clamp to conform to the structure of any boat tower.

14. A collapsible and selectively detachable apparatus secured to a boat tower comprising:

a supporting structure attached to said boat tower said supporting structure comprised of:

a hollow boom component having a first end and a second end, said first end and second end having an aperture to receive a detent pin;

a solid boom component having a first end and a second end, said first end having an aperture to receive a detent pin, said solid boom component slidably attached to said hollow boom component so that said solid boom component is capable of sliding within said hollow boom component, said hollow boom component and said solid boom component constructed of aircraft aluminum;

at least one brace constructed of a first bow brace end component, a bow brace center component, and a second bow brace end component, wherein one end of said first and second bow brace end components is tapered having an aperture;

at least one brace clamp for securing sad at least one brace to said hollow boom component, said at least one brace clamp having an aperture adapted to receive a pivotal attachment member;

at least one tower clamp for securing said at least one brace to said boat tower, said at least one tower clamp having an aperture to receive a quick release pin; and at least one main boom clamp which secures said hollow boom component to a said at least one boat tower component, said at least one main boom clamp having an aperture to receive a quick release pin.

15. The apparatus of claim 14, wherein said at least one brace clamp has at least one aperture adapted to engage said at least one brace with a corresponding aperture using a lynch quick release pin.

16. The apparatus of claim 15, wherein said at least one brace has at least one end adapted to be engaged by said at least one clamp having a quick release pin.

* * * * *